US012006098B2

(12) United States Patent
Sunning

(10) Patent No.: US 12,006,098 B2
(45) Date of Patent: Jun. 11, 2024

(54) COMPOSITE CONTAINER WITH SEPARABLE TOP, A BODY BLANK, AND A METHOD OF SEPARATING A TOP END PORTION FROM A MAIN BODY OF THE CONTAINER

(71) Applicant: AR Packaging Systems AB, Lund (SE)

(72) Inventor: Eva Sunning, Annelöv (SE)

(73) Assignee: GPI Systems AB, Lund (SE)

( * ) Notice: Subject to any disclaimer, the term of this patent is extended or adjusted under 35 U.S.C. 154(b) by 424 days.

(21) Appl. No.: 17/271,330

(22) PCT Filed: Aug. 29, 2019

(86) PCT No.: PCT/SE2019/050809
§ 371 (c)(1),
(2) Date: Feb. 25, 2021

(87) PCT Pub. No.: WO2020/046196
PCT Pub. Date: Mar. 5, 2020

(65) Prior Publication Data

US 2021/0323716 A1 Oct. 21, 2021

(30) Foreign Application Priority Data

Aug. 31, 2018 (SE) ..... 1851035-4

(51) Int. Cl.
*B65D 3/26* (2006.01)
*B65D 3/02* (2006.01)
(Continued)

(52) U.S. Cl.
CPC ..... *B65D 3/263* (2013.01); *B65D 3/02* (2013.01); *B65D 15/08* (2013.01); *B65D 65/40* (2013.01);
(Continued)

(58) Field of Classification Search
CPC ..... B65D 3/263; B65D 3/02; B65D 15/08; B65D 77/2004; B65D 77/32; B65D 65/40
See application file for complete search history.

(56) References Cited

U.S. PATENT DOCUMENTS 1,064,787 A 6/1913 Taylor
1,396,282 A 11/1921 Penn
(Continued)

FOREIGN PATENT DOCUMENTS

CH 280201 A 1/1952
CN 88102720 A 11/1988
(Continued)

OTHER PUBLICATIONS

International Search Report for Application No. PCT/SE2019/050809, dated Nov. 5, 2019, pp. 1-4.
(Continued)

*Primary Examiner* — Andrew M Tecco
*Assistant Examiner* — Nicholas E Igbokwe
(74) *Attorney, Agent, or Firm* — Womble Bond Dickinson (US) LLP

(57) ABSTRACT

A composite container comprises a tubular body, the tubular body having an inside surface and an outside surface and a container opening at a top end of the tubular body. The composite container comprises a top rim surrounding the container opening, the top rim being attached to a top end portion of the tubular body at the top end of the tubular body, and a lid for opening and closing the composite container. The composite container comprises a separation arrangement, for separating the top end portion of the tubular body together with the attached top rim from a main part of the tubular body, the separation arrangement comprising a tear strip formed between a pair of inside score lines which are arranged from the inside surface of the tubular body.

16 Claims, 7 Drawing Sheets

(51) Int. Cl.

| | |
|---|---|
| ***B65D 8/00*** | (2006.01) |
| ***B65D 65/40*** | (2006.01) |
| ***B65D 77/20*** | (2006.01) |
| ***B65D 77/32*** | (2006.01) |

(52) U.S. Cl.

CPC ..... *B65D 77/2004* (2013.01); *B65D 77/32* (2013.01); *B65D 2565/385* (2013.01)

(56) References Cited

U.S. PATENT DOCUMENTS 1,515,277 A 11/1924 Root
1,733,674 A 10/1929 Leiman
2,073,636 A 3/1937 Holoubek
2,076,407 A 4/1937 Mandell
2,281,854 A 5/1942 Miller, Jr.
2,314,338 A 3/1943 Graves
2,317,651 A 4/1943 Talbot
2,324,670 A 7/1943 Bergen
2,348,377 A 5/1944 Goodyear
2,371,173 A 3/1945 Hothersall
2,409,655 A 10/1946 Annen
2,568,697 A 9/1951 Amberg
2,569,851 A 10/1951 Farrell
2,608,341 A 8/1952 Eckman
2,760,629 A 8/1956 Thagard, Jr.
2,795,366 A 6/1957 Magill
2,891,713 A 6/1959 O'Neil
2,898,025 A 8/1959 Walker
2,948,454 A 8/1960 Gillmore
3,042,285 A 7/1962 Smith
3,042,288 A 7/1962 Carpenter, Sr.
3,049,277 A 8/1962 Shappell
3,101,885 A 8/1963 Walsh
3,109,576 A 11/1963 Karl
3,195,763 A 7/1965 Fried et al.
3,195,799 A 7/1965 Denenberg
3,401,824 A 9/1968 Rouse
3,402,876 A * 9/1968 Kuchenbecker ..... B65D 5/542 229/5.6
3,409,206 A 11/1968 Slouka et al.
3,445,049 A 5/1969 Carpenter, Jr.
3,506,183 A 4/1970 Turpin et al.
3,655,111 A 4/1972 Surerus
3,669,346 A 6/1972 Leezer et al.
3,696,987 A 10/1972 Schuff
3,940,496 A 2/1976 Turpin et al.
4,078,686 A 3/1978 Karesh
4,091,929 A 5/1978 Krane
4,091,984 A 5/1978 McFarland
4,198,901 A 4/1980 Knudsen
4,207,725 A 6/1980 Smith
4,210,618 A 7/1980 Piltz
4,495,209 A 1/1985 Whiteside
4,533,063 A 8/1985 Buchner et al.
4,556,152 A 12/1985 Bogren
4,606,462 A * 8/1986 Bogren ..... B65D 3/263 229/233
4,621,736 A 11/1986 Roccaforte
4,632,298 A 12/1986 Schellengerg
4,736,870 A 4/1988 Christensson
4,804,101 A 2/1989 Heath
4,850,503 A 7/1989 Larsson
4,865,203 A * 9/1989 Ueda ..... B65D 5/068 229/206
4,883,193 A 11/1989 Christensson
4,888,222 A 12/1989 Gibbons
4,921,121 A 5/1990 Duvander et al.
5,487,506 A 1/1996 Drummond et al.
5,511,680 A 4/1996 Kinne
5,514,394 A 5/1996 Lenahan
5,566,529 A 10/1996 Sireix
5,617,705 A 4/1997 Sanfilippo et al.
5,641,118 A 6/1997 Benham
5,685,480 A 11/1997 Choi
5,752,646 A 5/1998 Sandstrom
5,803,294 A 9/1998 Bello et al.
5,820,016 A 10/1998 Stropkay
5,897,019 A 4/1999 Stropkay
5,950,917 A 9/1999 Smith
6,047,878 A 4/2000 Lowry
6,092,717 A 7/2000 Lowry
6,165,114 A 12/2000 Stahlecker et al.
6,251,203 B1 6/2001 Vala et al.
6,325,232 B1 12/2001 Luttmann
6,415,940 B1 7/2002 Brabson, II
6,450,351 B1 9/2002 Thompson
6,644,541 B2 11/2003 Stewart
6,761,279 B1 7/2004 Martin et al.
7,169,418 B2 1/2007 Dalton
7,201,714 B2 4/2007 Zoeckler et al.
7,370,788 B1 5/2008 Otani et al.
7,703,625 B2 4/2010 Westphal
7,757,879 B2 7/2010 Schuetz
7,798,319 B1 9/2010 Bried
8,025,171 B2 9/2011 Cassol
8,220,701 B2 7/2012 Fontaine et al.
8,317,671 B1 11/2012 Zoeckler
8,403,819 B2 3/2013 Zoeckler
8,403,820 B2 3/2013 Zoeckler
8,684,224 B2 4/2014 House
8,915,395 B2 12/2014 Gersovitz
9,387,963 B2 7/2016 McBroom
9,718,574 B2 8/2017 Sireix
9,815,579 B2 11/2017 Larsson et al.
9,821,527 B2 11/2017 Hagelqvist
9,975,305 B2 5/2018 Strand et al.
10,370,158 B2 8/2019 Herlin et al.
10,730,660 B2 8/2020 Herlin et al.
10,736,468 B2 8/2020 Herlin et al.
10,787,280 B2 9/2020 Herlin et al.
11,111,062 B2 9/2021 Herlin et al.
11,192,688 B2 12/2021 Herlin et al.
2002/0107127 A1 8/2002 Buisson
2002/0130126 A1 9/2002 Rosenberg
2003/0111522 A1 6/2003 Deering et al.
2003/0183540 A1 10/2003 Onishi
2004/0050437 A1 3/2004 Engel et al.
2004/0142133 A1 7/2004 De Coninck
2004/0206052 A1 10/2004 Shean
2004/0238553 A1 12/2004 Lane et al.
2005/0051461 A1 3/2005 Bryant
2005/0173501 A1 8/2005 Jones
2005/0189406 A1 9/2005 Welchel et al.
2005/0190995 A1 9/2005 Koyanagi
2005/0223680 A1 10/2005 Sireix
2005/0252952 A1 11/2005 Nomula
2006/0057315 A1 3/2006 De Coninck et al.
2006/0124719 A1 6/2006 Mannlein
2006/0254942 A1 11/2006 Cargile, Jr.
2006/0257534 A1 11/2006 Maddock
2006/0289542 A1 12/2006 Schedl
2007/0090105 A1 4/2007 Elgebrant
2007/0145001 A1 6/2007 Tilto
2007/0157577 A1 7/2007 Buisson
2007/0170236 A1 7/2007 Rasanen
2007/0234667 A1 10/2007 Lubker et al.
2007/0235512 A1 10/2007 Drummond
2008/0041861 A1 2/2008 Crawford et al.
2008/0110896 A1 5/2008 Westphal
2008/0156805 A1 7/2008 Perry et al.
2008/0156808 A1 7/2008 Perry et al.
2009/0039078 A1 2/2009 Sanfilippo et al.
2009/0177179 A1 7/2009 Engelbrecht
2009/0236346 A1 9/2009 Hofeldt et al.
2009/0314775 A1 12/2009 Dietrich et al.
2010/0018883 A1 1/2010 Patel
2010/0065557 A1 3/2010 Gersovitz
2010/0108670 A1 5/2010 Perry et al.
2010/0133127 A1 6/2010 Jenner
2010/0140129 A1 6/2010 Sanfilippo
2010/0142862 A1 6/2010 Sam
2010/0180553 A1 7/2010 Tilton
2010/0270301 A1 10/2010 Cronin

(56) References Cited

U.S. PATENT DOCUMENTS

| | | | | |
|---|---|---|---|---|
| 2010/0308044 | A1 | 12/2010 | Perry et al. | |
| 2010/0308065 | A1 | 12/2010 | Vandamme et al. | |
| 2010/0308066 | A1 | 12/2010 | Perry et al. | |
| 2011/0006066 | A1 | 1/2011 | Vandamme et al. | |
| 2011/0240666 | A1 | 10/2011 | Mihaylov | |
| 2011/0253725 | A1 | 10/2011 | Killian | |
| 2012/0103353 | A1 | 5/2012 | Sebastian et al. | |
| 2012/0125932 | A1 | 5/2012 | Sierra-Gomez | |
| 2012/0298733 | A1 | 11/2012 | Xu et al. | |
| 2013/0029823 | A1 | 1/2013 | Zoeckler | |
| 2013/0048125 | A1 | 2/2013 | Hoffman et al. | |
| 2013/0092312 | A1 | 4/2013 | Cassoni | |
| 2013/0186901 | A1 | 7/2013 | Lejon et al. | |
| 2014/0109522 | A1 | 4/2014 | Sanfilippo | |
| 2014/0215973 | A1 | 8/2014 | Hagelqvist | |
| 2014/0262903 | A1* | 9/2014 | Mitten | B65D 55/06 206/459.5 |
| 2014/0287901 | A1 | 9/2014 | Hagelqvist | |
| 2015/0038309 | A1 | 2/2015 | Hoffman et al. | |
| 2015/0099616 | A1 | 4/2015 | Chapman et al. | |
| 2015/0148208 | A1 | 5/2015 | Sireix | |
| 2016/0000270 | A1 | 1/2016 | Wiggins et al. | |
| 2016/0137377 | A1 | 5/2016 | Tracy | |
| 2017/0073142 | A1 | 3/2017 | Loomis et al. | |
| 2017/0247159 | A1 | 8/2017 | Hansen | |
| 2017/0283136 | A1 | 10/2017 | Branyon | |
| 2017/0297769 | A1 | 10/2017 | Gersovitz | |
| 2018/0016038 | A1 | 1/2018 | Herlin | |
| 2018/0022505 | A1 | 1/2018 | Herlin et al. | |
| 2018/0194527 | A1 | 7/2018 | Sasaki et al. | |
| 2018/0229907 | A1 | 8/2018 | Gayer | |
| 2018/0237206 | A1 | 8/2018 | Jobe | |
| 2018/0311940 | A1 | 11/2018 | Toft et al. | |
| 2019/0127107 | A1 | 5/2019 | Herlin et al. | |
| 2021/0070520 | A1* | 3/2021 | Huffer | B65D 51/20 |
| 2021/0206544 | A1 | 7/2021 | Holka et al. | |
| 2022/0135260 | A1 | 5/2022 | Larsson | |
| 2023/0054953 | A1 | 2/2023 | Graham | |

FOREIGN PATENT DOCUMENTS

| | | | |
|---|---|---|---|
| CN | 1914096 | A | 2/2007 |
| CN | 2915695 | Y | 6/2007 |
| CN | 101391493 | A | 3/2009 |
| CN | 201338810 | | 11/2009 |
| CN | 101754912 | | 6/2010 |
| CN | 102190118 | A | 9/2011 |
| CN | 101670909 | B | 1/2012 |
| CN | 102991764 | A | 3/2013 |
| CN | 103895952 | A | 7/2014 |
| CN | 103979180 | A | 8/2014 |
| CN | 104812680 | A | 7/2015 |
| CN | 107108068 | A | 8/2017 |
| CN | 206954829 | U | 2/2018 |
| CN | 208559788 | U | 3/2019 |
| DE | 884862 | C | 7/1953 |
| DE | 3411371 | A1 | 10/1985 |
| DE | 10 2005 026903 | A1 | 8/2006 |
| DE | 10 2014 000 543 | A1 | 7/2015 |
| EP | 0 013 132 | A1 | 7/1980 |
| EP | 0 062 929 | A2 | 10/1982 |
| EP | 0 094 359 | A2 | 11/1983 |
| EP | 0 104 548 | B1 | 6/1987 |
| EP | 0 312 513 | A2 | 4/1989 |
| EP | 0 370 982 | A1 | 5/1990 |
| EP | 0 611 703 | A2 | 8/1994 |
| EP | 0 820 936 | A2 | 1/1998 |
| EP | 1818259 | A2 | 8/2007 |
| EP | 1 842 792 | B1 | 10/2008 |
| EP | 2 716 551 | A1 | 4/2014 |
| EP | 2 719 637 | A1 | 4/2014 |
| EP | 2 731 874 | A1 | 5/2014 |
| EP | 2 927 132 | A1 | 10/2015 |
| EP | 3 085 636 | A1 | 10/2016 |
| EP | 3 095 600 | A1 | 11/2016 |
| EP | 3162553 | A1 | 5/2017 |
| EP | 3 409 470 | A1 | 2/2018 |
| EP | 3 342 720 | A1 | 7/2018 |
| EP | 3 442 875 | | 2/2019 |
| EP | 3 481 727 | | 5/2019 |
| EP | 3 546 387 | | 10/2019 |
| EP | 3 578 477 | | 12/2019 |
| FR | 1358396 | A | 4/1964 |
| FR | 828311 | A | 5/1983 |
| FR | 2716408 | A1 | 8/1995 |
| FR | 2981333 | | 4/2013 |
| FR | 2986514 | A1 | 8/2013 |
| FR | 3043069 | | 5/2017 |
| GB | 190722536 | A | 10/1908 |
| GB | 1911 00947 | A | 12/1911 |
| GB | 819960 | A | 9/1959 |
| GB | 920354 | A | 3/1963 |
| GB | 998102 | A | 7/1965 |
| GB | 1038995 | A | 8/1966 |
| GB | 2 281 895 | A | 3/1995 |
| GB | 2526548 | A1 | 12/2015 |
| JP | S58-216539 | A | 12/1983 |
| JP | S5962435 | A | 4/1984 |
| JP | S60501305 | A | 8/1985 |
| JP | S61217350 | A | 9/1986 |
| JP | S6375 | A | 1/1988 |
| JP | H0285118 | A | 3/1990 |
| JP | H05-58640 | U | 8/1993 |
| JP | H09-99939 | A | 4/1997 |
| JP | H09-290822 | A | 11/1997 |
| JP | 3025434 | B2 | 3/2000 |
| JP | 2001-030383 | | 2/2001 |
| JP | 2003-231191 | | 8/2003 |
| JP | 2004-001884 | A | 1/2004 |
| JP | 2004-018100 | A | 1/2004 |
| JP | 2004-026197 | A | 1/2004 |
| JP | 2004155478 | A | 6/2004 |
| JP | 2004315094 | A | 11/2004 |
| JP | 2004-535993 | | 12/2004 |
| JP | 2005-041515 | | 2/2005 |
| JP | 2005-219319 | | 8/2005 |
| JP | 2005-333802 | | 12/2005 |
| JP | 3843510 | B2 | 11/2006 |
| JP | 2007-145415 | A | 6/2007 |
| JP | 2010-284866 | A | 12/2010 |
| JP | 2015-174690 | | 10/2015 |
| JP | 2016084169 | A | 5/2016 |
| JP | 2016088524 | A | 5/2016 |
| JP | 2016-179849 | A | 10/2016 |
| JP | 2019-137067 | | 8/2019 |
| JP | 6596835 | B2 | 10/2019 |
| JP | 2020-039532 | A | 3/2020 |
| KR | 10-2007-0113467 | | 11/2005 |
| SE | 453821 | B | 3/1988 |
| SE | 1651162 | A1 | 3/2018 |
| SU | 1433404 | A3 | 10/1988 |
| WO | WO 84/04511 | A1 | 11/1984 |
| WO | WO 87/03536 | A1 | 6/1987 |
| WO | WO 91/14623 | A1 | 10/1991 |
| WO | WO 03/039201 | | 5/2003 |
| WO | WO 2004/060767 | A1 | 7/2004 |
| WO | 2005032959 | A1 | 4/2005 |
| WO | WO 2005/075314 | A2 | 8/2005 |
| WO | WO 2006/068585 | A1 | 6/2006 |
| WO | WO 2009/130043 | | 10/2009 |
| WO | WO 2020/211939 | A1 | 10/2010 |
| WO | WO 2013/009227 | A1 | 1/2013 |
| WO | WO 2013/057392 | A1 | 4/2013 |
| WO | WO 2013/109174 | A1 | 7/2013 |
| WO | WO 2014/011938 | A2 | 1/2014 |
| WO | WO 2014/062119 | A1 | 4/2014 |
| WO | WO 2015/145600 | | 10/2015 |
| WO | WO 2015/145601 | | 10/2015 |
| WO | WO 2015187004 | A1 | 12/2015 |
| WO | WO 2016/030071 | A1 | 3/2016 |
| WO | WO 2016/034462 | A1 | 3/2016 |
| WO | 2016126193 | A1 | 8/2016 |
| WO | WO 2016/126191 | A1 | 8/2016 |

(56) References Cited

FOREIGN PATENT DOCUMENTS

| | | | |
|---|---|---|---|
| WO | WO 2016/126193 | A1 | 8/2016 |
| WO | WO 2017/180056 | A1 | 10/2017 |
| WO | WO 2018/009128 | A1 | 1/2018 |
| WO | WO 2018/009130 | A1 | 1/2018 |
| WO | WO 2018/009134 | A1 | 1/2018 |
| WO | WO 2018/009136 | A1 | 1/2018 |
| WO | WO 2018/009138 | A1 | 1/2018 |
| WO | WO 2018/217156 | A1 | 11/2018 |
| WO | WO 2019/068384 | A1 | 4/2019 |
| WO | WO 2019/226097 | A1 | 11/2019 |
| WO | WO 2020/261170 | A1 | 12/2020 |

OTHER PUBLICATIONS

International-Type Search Report for Application No. ITS/SE18/00039, dated Feb. 26, 2019, pp. 1-6.
Swedish Search Report for Application No. 1851035-4, dated Feb. 26, 2019, pp. 1-3.
Office Action dated Jun. 1, 2022 for Chinese Application No. 201980056628.4.
Machine Translation of JP S58-216539 A to Tomoo (Year: 1983).
Machine Translation of WO 2019/068384 A1 (2019).

* cited by examiner

COMPOSITE CONTAINER WITH SEPARABLE TOP, A BODY BLANK, AND A METHOD OF SEPARATING A TOP END PORTION FROM A MAIN BODY OF THE CONTAINER

CROSS-REFERENCE TO RELATED APPLICATIONS

The present application is a national phase entry under 35 U.S.C. § 371 of International Application No. PCT/SE2019/050809 filed Aug. 29, 2019, published in English, which claims priority from Swedish Patent Application No. 1851035-4 filed Aug. 31, 2018, all of which are incorporated herein by reference.

TECHNICAL FIELD

The disclosure pertains to a composite container comprising a tubular body, the tubular body having an inside surface and an outside surface and being closed at a bottom end of the tubular body opposite a container opening at a top end of the tubular body, the tubular body being made from a laminate sheet material comprising a carton layer and an inside polymeric layer, the inside polymeric layer being arranged at an inside surface of the carton layer. The composite container further comprises a top rim, such as a plastic top rim, surrounding the container opening and being attached to a top end portion of the tubular body. A composite container as disclosed herein also comprises a lid for opening and closing the composite container. A body blank for forming a tubular body of a composite container and a method for separating the top end portion of the tubular body from a main portion of the tubular body are also disclosed herein.

BACKGROUND

In the area of disposable containers for products such as infant formula, tobacco, detergents, etc. there is an ongoing need for diminishing the carbon footprint of such products. Efforts have been made to minimize the resource use for the disposable containers as well as to make the containers recyclable. The disposable containers referred to herein are composite containers having a tubular body which is made from a laminate sheet material comprising a carton layer, i.e. a layer made predominantly from cellulosic fibres. The tubular body may also comprise additional layers such as a barrier layer in the form of a metal foil, e.g. aluminium foil layer and one or more polymeric layers which may be polymeric barrier layers, bonding layers, protective layers, print, etc. A polymeric layer is commonly applied over a metal foil layer to protect the foil layer. The polymeric layer is commonly a thermoplastic layer which may contribute to forming a good seal when attaching components such as a top sealing member, a rim, etc. to the tubular container body by heat sealing techniques such as welding. The outside of the carton layer may be printed, and a further polymeric layer may be arranged on the outside of the carton layer to protect the carton layer from ambient moisture and to enhance the appearance of the container. The bottom of the container may be made from a folded-in end portion of the tubular body or may be a bottom disc which is attached to the tubular body at a bottom end thereof. In order to obtain good protection against air and moisture penetration for the whole interior space in the container, also the bottom disc may be made from a laminate sheet material comprising a carton layer and layers of metal foil and thermoplastic film.

In addition to the carton based laminate sheet materials used for the tubular body and an optional bottom disc, a composite container as disclosed herein has at least a non-carton based top rim which is attached as a separate component to the tubular body and which is made from a more durable material, such as plastic or metal. Commonly used disposable composite containers are provided with a firmly attached plastic top rim which is welded or glued to the tubular body of the container at the container opening. The top rim may be part of a lid component and the lid component may include a lid being attached by a hinge to the rim.

There is an increasing demand for efficient waste handling and recycling of the different components of composite containers. Hence, there is a need for an improved composite container allowing carton based container components to be processed separate from plastic and metal components after the composite container has been used and discarded.

An object of the present disclosure is to offer a means for improving recyclability of composite carton/plastic containers by facilitating removal of a firmly attached plastic component such as a rim or a lid component.

SUMMARY

The above object may be achieved with a composite container in accordance with claim 1, a body blank according to claim 14 and a separation method according to claim 15. Further embodiments are set out in the dependent claims, in the following description and in the drawings.

A composite container as set out herein comprises a tubular body, the tubular body having an inside surface and an outside surface and being closed at a bottom end of the tubular body opposite a container opening at a top end of the tubular body. The tubular body is made from a laminate sheet material comprising a carton layer and an inside polymeric layer, the inside polymeric layer being arranged at an inside surface of the carton layer. The composite container comprises a top rim surrounding the container opening, the top rim being attached to a top end portion of the tubular body at the top end of the tubular body, and a lid for opening and closing the composite container. The composite container further comprises a separation arrangement, for separating the top end portion of the tubular body together with the attached top rim from a main part of the tubular body, the separation arrangement comprising a tear strip comprising a portion of the inside polymeric layer, the tear strip being formed between a pair of inside score lines which are arranged in the laminate sheet material from the inside surface of the tubular body through only a part of a thickness of the laminate sheet material, the inside score lines and the tear strip extending in a circumferential direction of the tubular body, adjacent the top rim.

In order to preserve strength and shape stability of the composite container, and to make the tear strip invisible from the outside of the composite container, it may be preferred that no tear strip score lines are made from the outside of the tubular body.

As set out herein, the top end portion of the tubular body can be separated from the main portion of the tubular body and removed from the main portion of the tubular body together with the top rim. If the lid is connected to the top rim, the lid is removed at the same time as the top rim.

In the simplest embodiment of the separation arrangement as disclosed herein, the composite container may be provided only with a tear strip formed from the container material and including a band-shaped portion of the inside polymeric layer. In order to separate the top part of such a composite container from the main part of the composite container, a user would need to use a tool, such as a knife, to break the tubular body in the vicinity of an end of the tear strip or to create an end of the tear strip at the break in the tubular body. Such tool may subsequently also be used to bend out the end portion of the tear strip from the tubular body so that the end portion can be gripped and tearing can be initiated by pulling at the end portion of the tear strip.

It may be preferred that the tear strip has an extension in the circumferential direction of the tubular body corresponding to 90% or more of a circumference of the tubular body in order to be able to easily remove a top end portion or a bottom end portion of the tubular body without using a tool such as a pair of scissors or a knife and without having to apply a large force for ripping off a remaining connection between the end portion and the main portion of the tubular body. However, in some instances it may be sufficient that the tear strip has an extension of at least 45% of the circumference of the tubular body so that a gap of sufficient size can be created in the tubular body for allowing a hand to be inserted into the gap. Thereby, it may be possible to firmly grip the rim which is attached at the end portion of the tubular such that the rim can be ripped away from the main portion of the tubular body. The tear strip in a composite container as disclosed herein may have an extension in the circumferential direction of the tubular body corresponding to 45% to 90% of the circumference of the tubular body, such as 48% to 98% or 50% to 100% of the circumference of the tubular body. The tear strip as disclosed herein, may be a continuous tear strip or may be divided into two or more parts. In a corresponding manner, the inside score lines delimiting the tear strip may be continuous or discontinuous.

The separation arrangement may comprise a first opening part for accessing a first end of the tear strip, the first opening part comprising a portion of the carton layer and being formed by a set of opening part outside score lines arranged in the laminate sheet material from the outside surface of the tubular body through only a part of the thickness of the laminate sheet material adjacent the first end of the tear strip.

Furthermore, the separation arrangement may comprise a second opening part for accessing a second end of the tear strip, the second opening part comprising a portion of the carton layer and being formed by a set of opening part outside score lines arranged in the laminate sheet material from the outside surface of the tubular body through only a part of the thickness of the laminate sheet material adjacent the second end of the tear strip. The second opening part may be arranged separate from the first opening part or may be coincident with the first opening part such that a single opening part is arranged between the first and the second ends of the tear strip and may serve to provide access to both the first and the second end of the tear strip.

An opening part is preferably arranged at least at one end of the tear strip in order to provide easy access to the end of the tear strip. When wishing to separate the top part of the tubular body with an attached rim or a lid and a rim from the main part of the tubular body, the opening part is pushed inward towards the interior of the composite container whereby an opening is created in the tubular body. The opening is preferably large enough to permit a user to insert a finger into the opening and to grip an adjacent end portion of the tear strip. The opening part may be arranged to break away completely from the tubular body or may stay attached to the adjacent end of the tear strip. If the opening part stays attached to the tear strip, it may form all or part of a pull-tab which may be gripped in order to initiate tearing of the tear strip.

As set out herein, the separation arrangement may comprise a first pull-tab which is arranged at the first end of the tear strip, the first pull-tab comprising a portion of the carton layer and being formed by a set of first pull-tab outside score lines arranged in the laminate sheet material from the outside surface of the tubular body through only a part of the thickness of the laminate sheet material. The pull-tab is an integral end portion of the tear strip and may be connected to an opening part, which may form a part of the pull-tab, as set out above. When the opening part stays connected to an end portion of the tear strip such as a pull-tab after the opening part has been pushed into the composite container, the opening part may be folded back onto the end portion of the tear strip to create a double, thickened pull-tab.

The separation arrangement as disclosed herein may further comprise a second pull-tab which is arranged at the second end of the tear strip, the second pull-tab comprising a portion of the carton layer and being formed by a set of second pull-tab outside score lines arranged in the laminate sheet material from the outside surface of the tubular body through only a part of the thickness of the laminate sheet material.

As set out herein, a single opening part may be arranged between two pull-tabs. The opening part may be arranged to break away completely from the tubular body of the composite container when being pushed into the composite container, or may stay attached to a pull-tab or to the tubular body. The arrangement of a pull-tab at each end of the tear strip facilitates tearing from either or both of the first and the second end of the tear strip. The tear strip may be a two-part tear strip where the tear strip is divided e.g. at a seal in the tubular body which is formed between two side edges of a body blank forming the tubular body of the composite container.

The tubular body of a composite container as disclosed herein is formed from a body blank which is bent into a tube shape, thereby bringing two opposing side edges of the body blank together in an end-to-end join, also known as a "butt join" or in an overlapping join. The join extends in a height direction of the tubular body between the top end and the bottom end of the tubular body. An end-to-end join is subsequently sealed by means of a sealing strip which is welded to the inside surface of the tubular body. A sealing strip may also be applied over an overlapping join, in order to avoid cut edges of the carton layer to be exposed to the contents in the composite container.

The tubular body may be sealed at the bottom end by application of a bottom sealing member, also referred to herein as a "bottom disc". The bottom disc may be formed from a laminate bottom sheet material which is similar to the material in the tubular body of the composite container. Accordingly, the bottom disc may comprise a carton layer, an optional metallic foil layer and a thermoplastic polymeric layer being arranged at an inside surface of the carton layer facing towards an interior of the tubular body, with the metallic foil layer being arranged between the carton layer and the thermoplastic polymeric layer. The bottom sealing member may be applied to the tubular body in the same manner as a top sealing member.

An alternative way of sealing the bottom end of the tubular body is by folding in and sealing the sheet material at the bottom end of the tubular body.

The sealing strip is preferably welded to the inside surface of the tubular body by means of high frequency induction welding. Application of container components such as a top sealing member, a bottom sealing member, a top rim and a bottom rim may be performed using an attachment unit comprising a welding unit, such as a high frequency welding unit, which is configured to fasten the component to the tubular body during production of the composite container. The welding unit may comprise an inductive welding energy generator for softening or melting a weldable layer that forms part of the tubular body and/or the applied container component.

The join in the tubular body constitutes a reinforced part of the tubular body and creates a discontinuity in the tear strip which is formed in the inside polymeric layer. It may be preferred if the tear strip is arranged as a two-part tear strip which can be torn towards the join in the tubular body from first and second ends of the tear strip. The first and second ends of the tear strip may be arranged at the same circumferential distance from the join in the tubular body. By way of example, in a composite container having a generally rectangular or square cross-sectional shape, the first and second ends of the tear strip may be arranged in a container wall which is opposite a container wall in which the join is arranged. A composite container having a generally rectangular or square cross-sectional shape may have a designated container front wall and a designated container back wall, the front wall and back wall being connected by opposing side walls. A particularly preferred arrangement may be that the first and second ends of the tear strip are arranged in a container side wall and that the join is arranged in the opposite side wall. However, it is also conceivable to arrange the first and second ends of the tear strip in the container front wall, opposite a join in the container back wall or in a corner portion of the tubular body of the composite container.

The inside score lines which delimit the tear strip from the adjacent parts of the inside polymeric layer may be arranged in the laminate sheet material from the inside surface of the tubular body through a full thickness of the inside polymeric layer, through a full thickness of an optional metal foil layer and through only a part of a thickness of the carton layer.

The carton layer of the laminate sheet material of a tubular body as disclosed herein may have a thickness of from 0.5 millimeter to 1.0 millimeter, such as from 0.6 millimeter to 0.8 millimeter or from 0.65 millimeter to 0.7 millimeter. Depending on the container size and packaging purpose other dimensions may be used.

The score lines may extend into the carton layer from the inside surface to a depth corresponding to 15%-60% of the thickness of the carton layer, such as 20%-55% of the carton layer. It may be preferred that the depth of the score lines is 50% or less of the thickness of the carton layer. The non-cut part of the thickness of the carton layer provides integrity and stability of the tubular body within the area of the tear strip.

The inside polymeric layer of the laminate sheet material of a tubular body as disclosed herein may have a thickness of from 20 micrometer to 100 micrometer, such as from 30 micrometer to 75 micrometer or from 30 micrometer to 50 micrometer.

Without wishing to be bound by theory, it is believed that the polymeric layer serves to strengthen the tear strip and increasing its coherency by fixating the fibres between the cuts in the laminate sheet material. Thereby, negative influence from uncut fibres extending across the cuts in the non-cut part of the carton layer may be minimized. The non-cut fibers at the bottom of the partial cuts through the thickness of the carton layer may otherwise cause an inadvertent change in the tear direction when tearing open the tubular body of the composite container and may even cause the tear strip to rupture.

The inside score lines of the pair of inside score lines which are formed in the inside surface of the tubular body may be arranged at a distance from each other of from 3 millimeter to 10 millimeter. The distance between the inside score lines defines a width of the tear strip. The inside score lines may run parallel to each other or may have different spacing in different parts of the tear strip, whereby the tear strip has different widths in different parts of the tear strip. By way of example, the score lines may be arranged at a greater distance from each other at one or both ends of the tear strip than in other parts of the tear strip in order to create a pull-tab and/or a lead-in part for improving tear initiation and tear propagation for the tear strip.

The tear strip is preferably arranged at a distance from a lower edge of the top rim which is as small as possible in order to remove a minimum of the carton based material in the tubular body when removing the top rim. A distance between the lower edge of the top rim and the tear strip may preferably be less than 15 millimeters, such as from 1 to 10 millimeters, as measured between the lower edge of the top rim and an upper edge of the tear strip. Correspondingly, a distance between an upper edge of a bottom rim and the tear strip may preferably be less than 15 millimeters, such as from 1 to 10 millimeters, as measured between the upper edge of the top rim and a lower edge of the tear strip.

The distance between the nearest edge of a top or bottom rim and a corresponding tear strip may vary along a length of the tear strip. It may be convenient to have an end of the tear strip were the tearing is initiated placed at a distance from the rim allowing room for accessing the end of the tear strip and any features such as an opening part and/or a pull-tab associated with the end of the tear strip. It may then be desirable that the inside score lines are arranged to lead in from the end of the tear strip towards the rim in order to minimize the amount of carton material which is removed together with the rim.

The composite container as disclosed herein preferably comprises a top sealing member which is attached to the inside surface of the tubular body at a distance from the top end of the tubular body. The separation arrangement is preferably arranged between the top sealing member and the top rim.

The top sealing member may be an openable or peelable top sealing member, implying that it may be fully or partly removed by a user in order to provide initial access to an interior compartment of the composite container either by breaking a seal between the top sealing member and the inside surface of the tubular body, or by tearing or otherwise breaking the top sealing member itself.

The top sealing member may be gastight or gas-permeable. A gastight top sealing member may be manufactured from any material or material combination suitable for providing a gastight sealing of a compartment delimited by the sealing membrane, such as aluminium foil, silicon-coated paper, carton, plastic film, or laminates thereof. A gastight top sealing member is particularly advantageous when the contents in the composite container are sensitive to air and/or moisture.

The top sealing member may be attached to the tubular body by welding a peripheral flange of the top sealing member to the inside surface of the tubular body. As disclosed herein, the top sealing member is commonly a flexible component made from a laminate of one or more layers of aluminium foil and outer layers of thermoplastic polymeric material and the peripheral flange is created by folding an edge portion of the top sealing member out of the plane of the top sealing member and into alignment with the inside surface of the tubular body. The top sealing member is applied at a distance from the top end edge of the tubular body to allow for attachment of the top rim above the top sealing member. If the composite container comprises a scoop, a leaflet, or other supplementary item, the top sealing member may be applied at a sufficient distance from the top end edge of the tubular body to allow the item to be accommodated in a space formed between the top sealing member and an inside surface of the lid. The distance between the top sealing member and the top end edge of the tubular body may be in the order of from 10 to 60 millimeters, such as in the order of from 20 to 50 millimeters. If the sealing membrane is placed at a distance of from 30 to 60 millimeters from the upper end edge of the container body, the space above the sealing membrane may be used to accommodate a scoop or other utensil provided together with the packaged goods.

Depending on whether the top sealing member is applied from the upper end of the tubular body or from the bottom end of the tubular body, the flange of the top sealing member which is joined to the inside surface of the tubular body may be directed upward toward the container opening or downward, toward the bottom end of the composite container.

The top sealing member constitutes a transport seal and is provided in addition to the openable and closable lid, to keep the contents in the composite container fresh and protected against contamination up until a first opening of the composite container by a consumer. A common type of top sealing member is a sealing disc comprising a top member and a bottom member. The top member is provided with cuts, forming a tear strip and a tear-away area which includes the tear strip. The tear-away area is delimited by a contour cut which forms an outer tear line extending in the top member along the full contour of the tear-away area. The tear-strip is formed by a different cut arranged inward of the contour cut in the top member. The top member and the bottom member are selectively interconnected in a peripheral border seal and at one or more locations within the tear strip and usually also within a further location in the tear-away area, outside of the tear strip. By pulling at the tear-strip formed in the top member, the connection or connections between the top member and the bottom member within the area constituted by the tear strip will cause the bottom member to break along the cuts in the top member. Thereby, both the top member and the bottom member within the tearable area can be removed from the container, making the contents in the container available for use.

A peelable top sealing member commonly takes the form of a flexible foil which may be provided with a grip tab or other gripping device for facilitating removal of the top sealing member.

The lid of the composite container as disclosed herein may be a part of a lid component, the lid component comprising the top rim and a lid part, or a frame structure and a lid part.

A frame structure as disclosed herein is a loop-shape component which is arranged to be connected to the top rim. Preferably, the lid component comprising a frame structure is mechanically attached to the top rim by a snap-fit connection, such as an irreversible snap-fit connection.

Alternatively, the lid may be a separate part of the composite container which can be completely removed when opening the composite container.

When the lid is part of a lid component, it is connected to the top rim or the frame structure by means of a hinge. The hinge may be a live hinge, i.e. a bendable connection between the lid and the top rim or frame structure. A live hinge may be formed integral with the lid and/or with the top rim or frame structure or may be a separately formed element which is attached to the lid and to the top rim or frame structure. Alternatively, the hinge may be a two-part hinge, with a first hinge part arranged on the lid and a second hinge part arranged on the top rim or frame structure.

If the lid comprises a first and a second lid part, the second lid part may be attached to the first lid part before or after attaching the lid component to a frame structure or to the upper reinforcing rim.

Disclosed herein is also a rectangular body blank for forming a tubular body in a composite container as disclosed herein. The body blank has a top edge and a bottom edge and two side edges, an inside surface and an outside surface. The body blank is made from a laminate sheet material comprising a carton layer and an inside polymeric layer, the inside polymeric layer being arranged at the inside surface of the body blank. The body blank comprises a separation arrangement as disclosed herein, the separation arrangement comprising a tear strip comprising a portion of the inside polymeric layer, the tear strip being formed between two inside score lines which are arranged in the laminate sheet material from the inside surface of the body blank through only a part of a thickness of the laminate sheet material and extending along the top edge of the body blank.

The tear strip divides the body blank into two parts corresponding to an end portion of the tubular body and a main portion of the tubular body. The tear strip may comprise two or more parts and may be provided with at least one pull-tab and/or an opening part arranged at an end of the tear strip, as disclosed herein in connection with the description of the tubular body. A further separation arrangement may be provided at the bottom edge of the body blank.

Disclosed herein is also a method of separating a top end portion of a composite container as disclosed herein from a main body portion of the composite container, the composite container comprising a tubular body, the tubular body having an inside surface and an outside surface and being closed at a bottom end of the tubular body opposite a container opening at a top end of the tubular body, the tubular body being made from a laminate sheet material comprising a carton layer and an inside polymeric layer, the inside polymeric layer being arranged at an inside surface of the carton layer, the composite container comprising a top rim surrounding the container opening, the top rim being attached to a top end portion of the tubular body at the top end of the tubular body, and a lid for opening and closing the composite container. The composite container further comprises a separation arrangement, for separating the top end portion of the composite container from the main body portion of the composite container, the separation arrangement comprising a tear strip comprising a portion of the inside polymeric layer, the tear strip being formed between a pair of inside score lines which are arranged in the laminate sheet material from the inside surface of the tubular body through only a part of a thickness of the laminate sheet material, the inside score lines and the tear strip extending in a circumferential direction of the tubular body, adjacent the top rim, and an opening part for accessing an end of the tear strip, the opening part comprising a portion of the carton layer and being formed by outside score lines arranged in the laminate sheet material from the outside surface of the tubular body through only a part of the thickness of the laminate sheet material adjacent the end of the tear strip, and a pull-tab which is arranged at the end of the tear strip, the pull-tab comprising a portion of the carton layer and being formed by outside score lines arranged in the laminate sheet material from the outside surface of the tubular body through only a part of the thickness of the laminate sheet material, wherein the method comprises the steps of:

- forming an opening in the tubular body by pushing the opening part in a direction towards an interior of the tubular body,
- inserting a finger into the opening in the tubular body and gripping the pull-tab,
- tearing the tubular body along the tear strip by pulling at the pull-tab; and
- removing the top end portion of the composite container from a main part of the composite container.

It is to be understood that a separation arrangement as disclosed herein is equally applicable for removing a bottom rim which has been attached at the bottom end of the tubular body. Accordingly, a composite container having both a top rim and a bottom rim may be provided with a separation arrangement as disclosed herein at both the top end and the bottom end. A bottom end separation arrangement may also be used to separate a bottom disc formed from plastic or metal from the main part of the tubular body.

As set out herein, the tear strip is arranged for facilitating separation of the plastic lid from the carton body in order to make it possible to properly separate different categories of household waste. Further score lines are preferably made on an outer surface of the body blank to form a pull-tab at an end of the tear strip and an opening part for facilitating accessing and gripping the tear strip.

As the inside score lines are formed on the inside surface of the body blank/tubular body, they are not visible from the outside of the composite container. If an opening part and/or a pull-tab is/are provided in the body blank/tubular body, the outside score lines forming such features are discernible on the outside surface of the body blank/tubular body.

In order for facilitating for a user to identify where the tear strip can be accessed, the outside of the body blank/tubular body may be provided with indications, such as printed or embossed indications. The indications may enhance the outline of an opening arrangement including an opening part and a pull-tab. Instructions for separating the top part of the composite container from the main part of the composite container may also be provided.

The tear strip of the separation arrangement as disclosed herein is formed from the packaging material itself. The main component of the tear strip is provided by the inside polymeric layer of the laminate sheet material forming the body blank/tubular body. The inside polymeric layer may be extruded or laminated onto the carton layer or an optional foil layer and may be made from any suitable thermoplastic polymer, as known in the art. Polyolefins such as polypropylene and polyethylene may be particularly suitable, with polyethylene being a preferred material for the inside polymeric layer. Accordingly, the separation arrangement as disclosed herein may be provided in a simple, efficient and economical manner without the need of using additional components or materials.

Definitions

A composite container as disclosed herein is a container having a tubular body made from carton based sheet material and at least one polymeric container component such as a rim, or a lid component which has been separately produced and subsequently attached to the tubular body of the composite container.

The carton based sheet materials used for forming the tubular body and the base sealing member are predominantly made from cellulose fibres or paper fibres forming a carton substrate layer in the sheet material. The carton layer may be a single ply or multi ply material.

The sheet materials are laminates which in addition to the carton layer comprise at least one thermoplastic polymeric layer in the form of a film or a coating on a surface of the material which is intended to be facing towards an interior of the composite container. The laminates may further comprise a barrier layer in the form of a metal foil layer, preferably an aluminum layer. The metal foil layer, if present, is covered by the at least one polymeric layer and is arranged at a surface of the sheet material which will form an inside surface of the composite container, i.e. at a surface which will be facing the interior of the composite container. A polymeric layer may also be arranged at a surface of the sheet material which will form an outer surface of the composite container. In addition to the inside polymeric layer, an optional metal foil layer and an optional outer polymer layer, the sheet material may be coated, printed, embossed, etc. and may comprise fillers, pigments, binders and other additives as known in the art.

The term "tubular body" should be understood to mean any hollow tubular shape a body blank assumes during manufacturing and filing of the composite containers as disclosed herein, as well as the shape the body has in the finally assembled and filled composite container. Accordingly, a tubular shape as used herein may be a cylindrical shape, or a shape with any other useful cross-section such as a square, rectangular or other polygonal cross section or modified polygonal cross sectional shapes with rounded corners. A tubular shape also includes any transient shape that the tubular body may assume during the manufacturing process. By way of example, the cross section of the tubular body may initially take on a drop-shape appearance with a distinct peak at the end-to-end join between the edges of the body blank and a curved portion opposite the peak.

The term "container component" as used herein refers to the tubular body of the composite container and any component which is directly or indirectly attached to the tubular body and forms part of the composite container as disclosed herein. Examples of container components which may be part of a composite container as disclosed herein are: a tubular body, a body sealing strip, a top sealing member, a bottom sealing member, a top rim, a reclosable lid, a lid component, a bottom rim, a scoop holder, and a scoop.

Top and bottom sealing members are sheet form components which are applied inside the tubular body of the composite container such that they cover a cross-sectional area of the tubular body. A bottom sealing member, or bottom disc, forms a bottom end closure of the composite container and the top sealing member forms an inner transport seal of the composite container. The top sealing member is usually attached at the access opening of the composite container, at a distance from the opening edge which is at least sufficient to allow for attachment of the top rim above the top sealing member and which may also allow for a scoop or other added item to be accommodated in the space between the top sealing member and the inside surface of the reclosable lid.

The top and bottom sealing members may be made from paper, carton, plastic film, aluminium foil and laminates of such materials. Usually, the bottom sealing member is a relatively stiff disc which is made from a laminate comprising a carton substrate layer and an aluminium foil layer on the side which will be facing towards the interior of the composite container. The bottom sealing member may further comprise at least one layer of thermoplastic polymeric material. The top sealing member is commonly a more flexible component made from a laminate of one or more layers of aluminium foil and outer layers of thermoplastic polymeric material. However, carton based top sealing members are also known in the art and may be used in the composite containers as disclosed herein. The top sealing member is commonly arranged to be partly or fully removed at an initial opening of the composite container and may be provided with opening means such as a tear strip, a grip tab, etc. as known in the art.

Top and bottom rims are commonly made from polymeric material, such as thermoformable polymeric material and take the form of a closed loop. The rims may be made by injection molding. A bottom rim is an optional component of a composite container as disclosed herein. The top rim, and the bottom rim, if present, are applied at the top and bottom ends of the tubular body of the composite container and are attached to the tubular body by means of adhesive, such as a thermoplastic adhesive. The rims provide the tubular body with enhanced rigidity at the end edges of the tubular body. The top rim cooperates with the container lid to form a reliable closure at the top end of the container. The top rim may be attached to the outer surface of the tubular body, to the inside surface of the tubular body or to both the outer surface and the inside surface of the tubular body. The top rim may be applied to cover an end edge of the tubular body and may optionally extend into the container on the inside surface of the tubular body.

The composite containers as disclosed herein are containers for dry or moist goods, often referred to as "bulk solids". Such products are non-liquid, generally particulate materials capable of being poured, scooped or taken by hand out of the cans. The containers are disposable containers, which are intended to be discarded after having been emptied of their contents.

A "particulate material" or "particulate product" should be broadly understood to include any material in the form of particles, granules, grinds, plant fragments, short fibres, flakes, seeds, pieces, etc. The particulate products which are suitable for packaging in the composite containers as disclosed herein are generally flowable non-liquid products, allowing a desired amount of the product to be poured, scooped or taken by hand out of the composite container.

A composite container as disclosed herein may be a container for alimentary or consumable products such as infant formula, coffee, tea, rice, flour, sugar, rice, peas, beans, lentils, cereals, soup powder, custard powder, pasta, snacks, or the like. Alternatively, the packaged product may be non-alimentary, such as tobacco, detergent, dishwasher powder, fertilizer, chemicals, or the like.

By an openable or peelable top sealing member is meant a sealing member that may be fully or partly removed by a user in order to provide initial access to an inner compartment of the composite container either by breaking a seal between the sealing member and the inside surface of the tubular body of the container, or by tearing or otherwise breaking the sealing member itself. Tearable sealing members may be provided with one or more predefined weakenings, such as perforations or a cut partly through the membrane and may have a tear strip arranged therein for facilitating removal of the sealing member. A peelable top sealing member is usually provided with a grip tab for facilitating initiation of the separation from the inside surface of the tubular body and subsequent removal of the sealing member.

A "firm" or "irreversible" connection as used herein is a connection which cannot be broken without destroying or damaging the connected parts.

High frequency induction welding may be a preferred method for attaching container components such as the body sealing strip, a bottom rim, and the top and bottom sealing members. However, other means for attaching container components may be used such as adhesive attachment, ultrasonic welding and thermowelding.

BRIEF DESCRIPTION OF THE DRAWINGS

The present invention will be further explained hereinafter by means of non-limiting examples and with reference to the appended drawings wherein.

DETAILED DESCRIPTION

The invention will, in the following, be exemplified by embodiments. The embodiments are included in order to explain principles of the invention and not to limit the scope of the invention, as defined by the appended claims. It is to be understood that the drawings are schematic and that individual components, such as layers of material are not necessarily drawn to scale. The packaging container and body blank shown in the figures are provided only as examples and should not be considered limiting to the invention. Accordingly, the scope of the invention is determined solely by the appended claims.

Figure 1A:
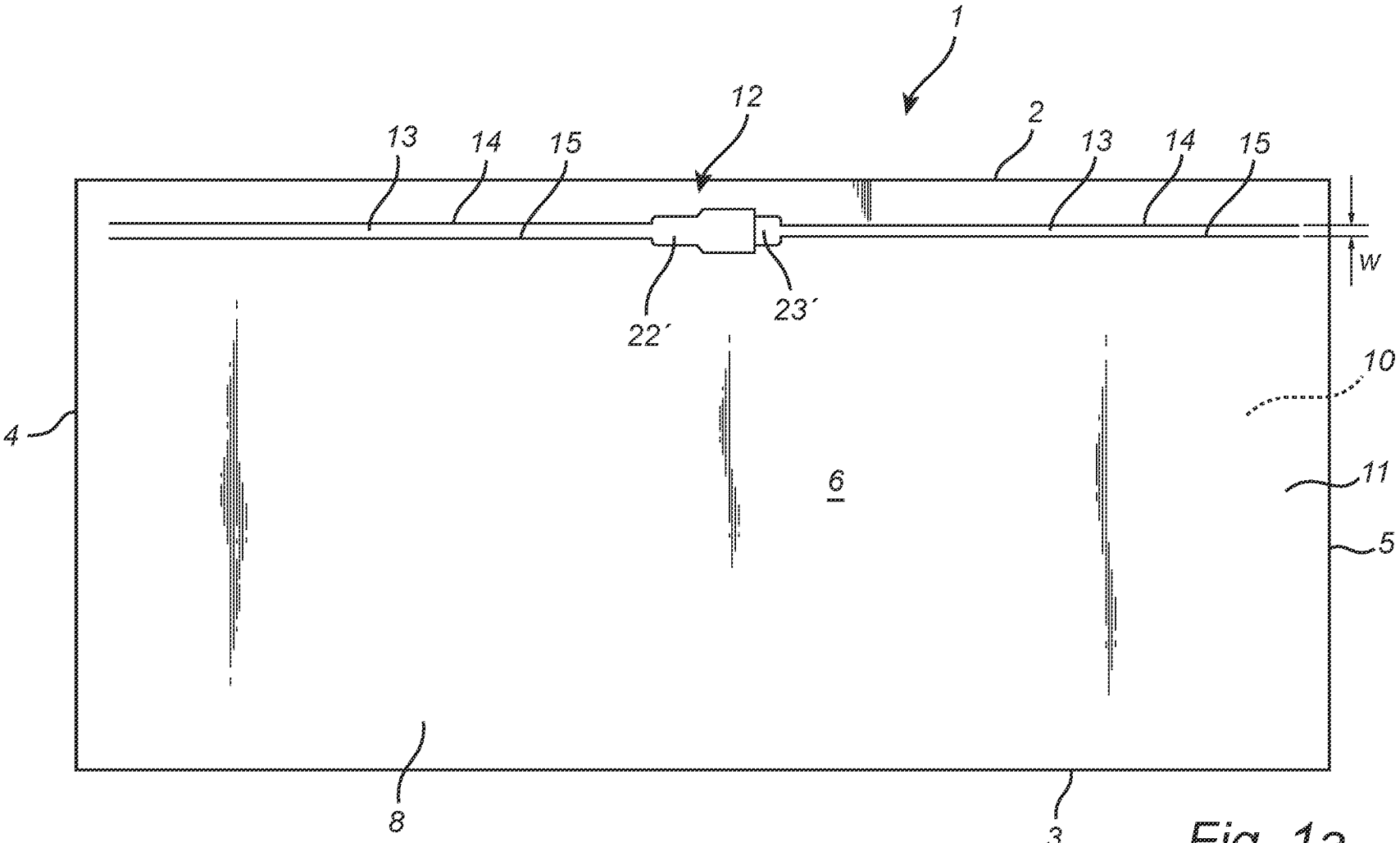
FIG. 1*a* shows a rectangular body blank as disclosed herein, from the inside surface.
Figure 1B:
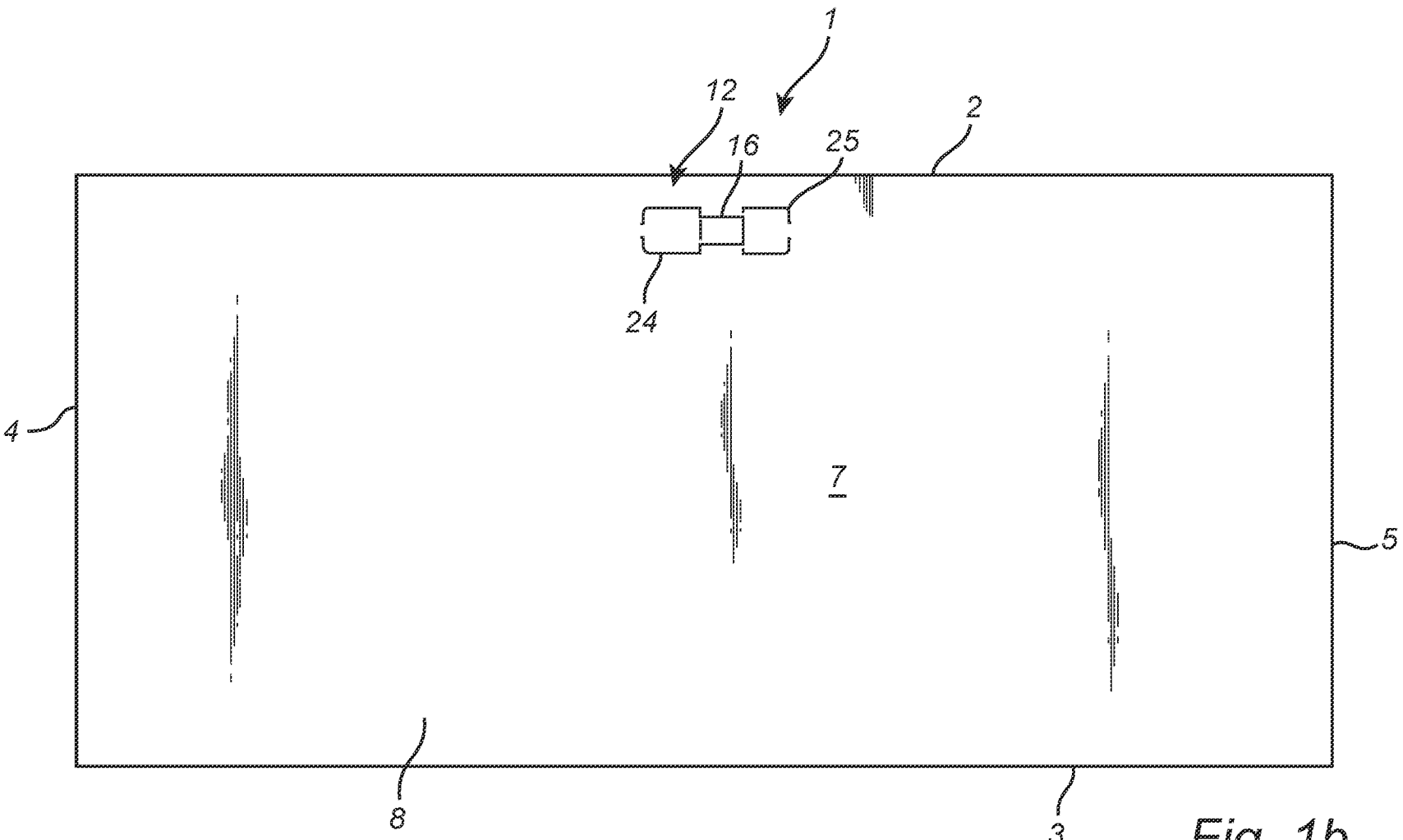
FIG. 1*b* shows a rectangular body blank as disclosed herein, from the outside surface.
Figure 1C:
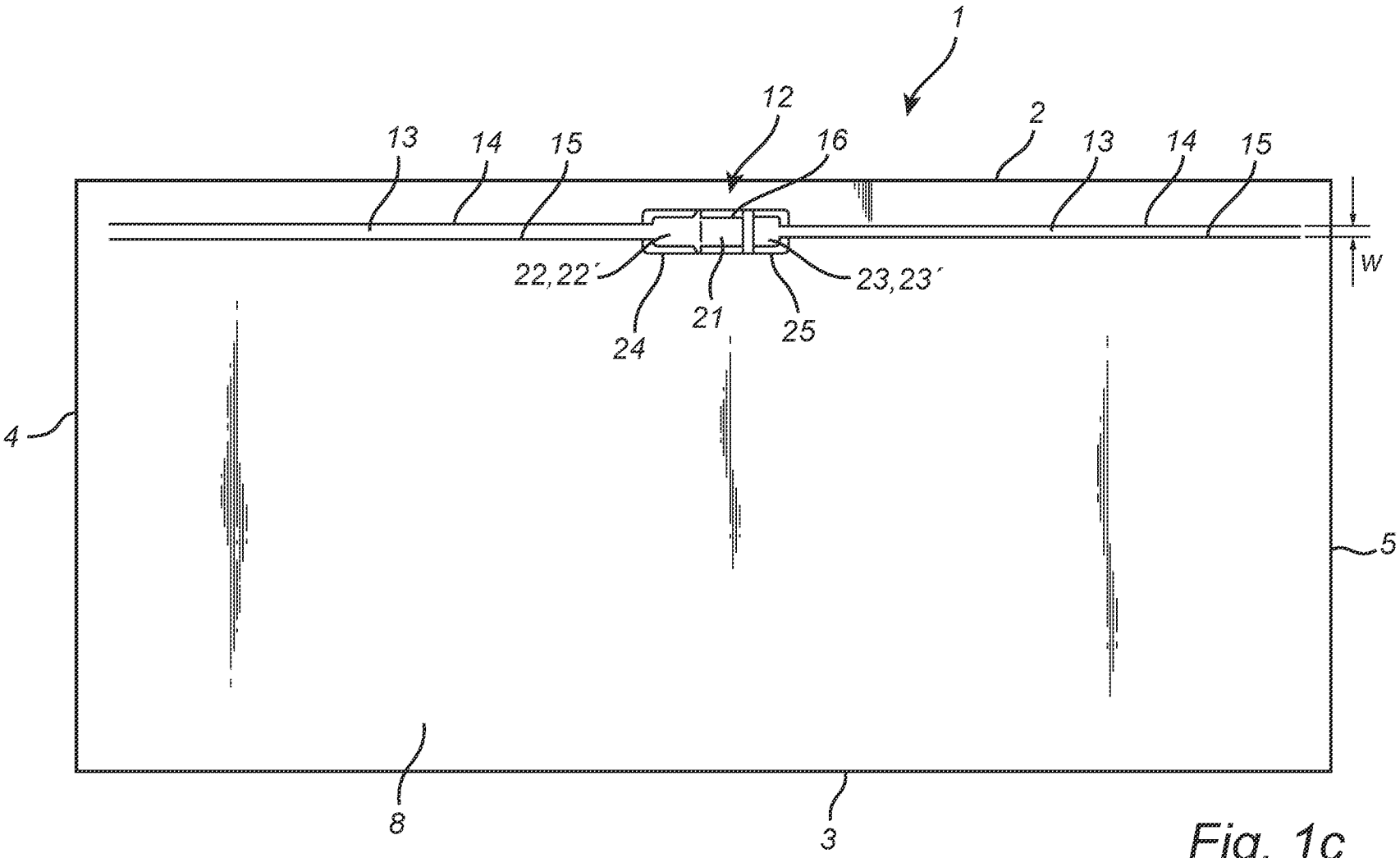
FIG. 1*c* shows a rectangular body blank as disclosed herein, with both inside and outside score lines visible.

FIGS. 1*a*, 1*b* and 1*c* show a rectangular body blank 1 for forming a tubular body in a composite container as disclosed herein. As the score lines which are arranged in the body blank 1 overlay each other and cooperate in forming the separation arrangement as disclosed herein, for the sake of facilitating understanding of the invention, FIG. 1*a* shows a mirror image of the inside surface of the body blank 1 as shown from the outside surface in FIG. 1*b*.

The body blank 1 has a top edge 2, a bottom edge 3, two side edges 4, 5, an inside surface 6 and an outside surface 7.

Figure 2:
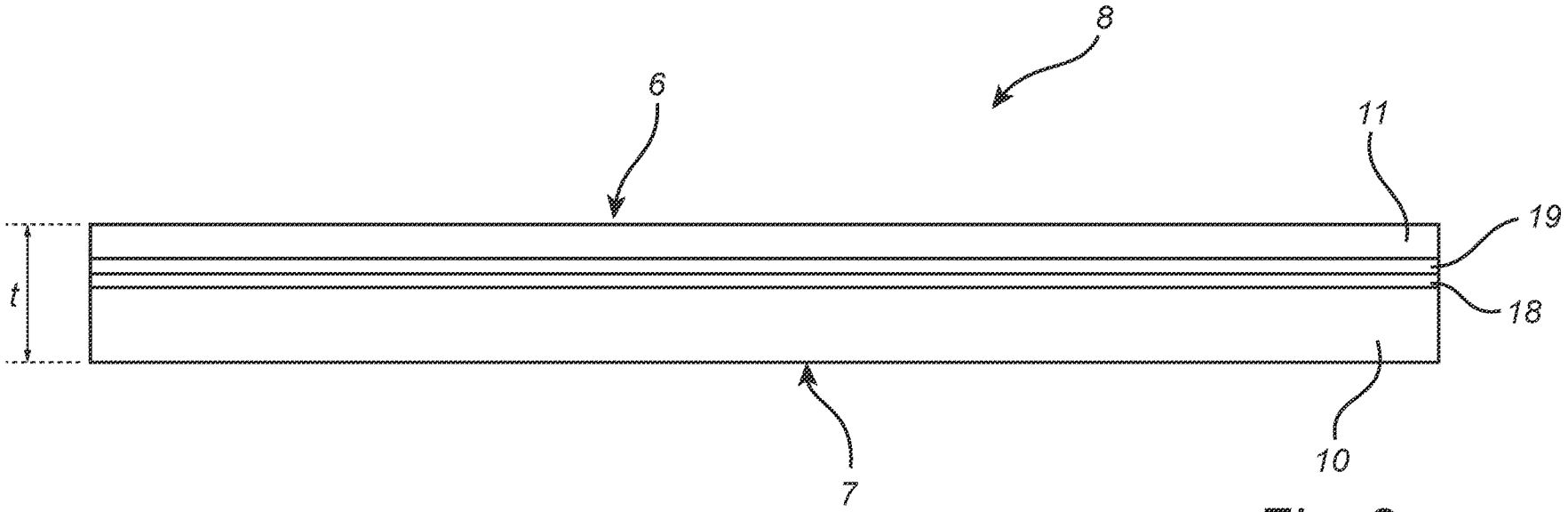
FIG. 2 shows a cross-section through a sheet material for a body blank.

The body blank 1 is made from a laminate sheet material 8 comprising a carton layer 10 and an inside polymeric layer 11. As is shown in FIGS. 1*a* and 2, the inside polymeric layer 11 is arranged at the inside surface 6 of the body blank. The body blank comprises a separation arrangement 12 comprising a tear strip 13. The tear strip 13 is formed between two inside score lines 14,15 which are arranged in the laminate sheet material 8 from the inside surface 6 of the body blank through only a part of a thickness, t, of the laminate sheet material 8 and extending along the top edge 2 of the body blank 1 at a distance from the top edge 2 of the body blank 1.

The distance between the top edge 2 of the body blank and the separation arrangement 12 is selected to be sufficient for accommodating a top rim being attached above the separation arrangement 12. The distance between the top edge 2 of the body blank and the closest part of the separation arrangement 12 in the body blanks as disclosed herein may be in the order of 10 millimeter, such as from 7 to 9 millimeter.

The inside score lines 14, 15 may be arranged at a distance from each other of from 3 millimeter to 10 millimeter. The distance between the score lines 14,15 may vary along the tear line 13, as set out herein.

With reference to FIG. 2, there is shown a cross-section through a sheet material 8 which may be used for forming a body blank and a tubular body made from the body blank as disclosed herein.

As set out herein, the laminate sheet material 8 comprises a carton layer 10 which forms a base layer constituting a major part of the thickness, t, of the sheet material. An inside polymeric layer 11 is applied on the side of the carton layer 10 which is intended to be facing towards an inner compartment in a composite container as disclosed therein. The inside polymeric layer 11 is an outer layer of the laminate sheet material 8 and forms the inside surface 6 of the laminate sheet material 8, corresponding to the inside surface 6 of the body blank 1 and the inside surface 306 of the tubular body 301 as disclosed with reference to FIG. 3, below. In FIG. 2, the outside surface 7 of the laminate sheet material 8 is constituted by an outer surface of the carton layer 10. However, the outside surface of the laminate sheet material 8 may alternatively be constituted by a printed layer, and/or by a polymeric coating or layer applied on the carton layer 10.

The laminate sheet material 8 shown in FIG. 2 further comprises a polymeric bonding layer 18 applied to the inner side of the carton layer and a metal foil layer 19 applied on the polymeric bonding layer 18, between the metal foil layer 19 and the carton layer 10. The polymeric bonding layer 18 and the metal foil layer 19 are optional parts of the laminate sheet material 8 as disclosed herein.

A laminate sheet material which may be used in a composite container as disclosed herein may comprise one or more layers in addition to the mandatory base layer/carton layer 10 and the inside polymeric layer 11. As seen in order from the outside to the inside the laminate material may comprise:

a) an optional polymeric coating, such as a laquer,
b) an optional printed and/or coloured layer
c) a carton layer
d) an optional polymeric bonding layer, e.g. a polyethylene (PE) layer
e) an optional barrier layer, e.g. an aluminum (Al) foil barrier layer
f) an inside polymeric layer, such as a polyethylene (PE) layer. The inside polymeric layer may comprise two or more sub-layers, such as a polyethylene (PE) layer and) a low density polyethylene (LDPE) layer. The sublayers may be coextruded to form the inside polymeric layer, or may be formed as separate films which are laminated together.

The tubular body may also comprise additional layers such as a barrier layer in the form of a metal foil, e.g. aluminium foil layer and one or more polymeric film layers. A polymeric film layer is commonly applied over a metal foil layer to protect the foil layer. The polymeric film layer is commonly a thermoplastic film layer which may contribute to forming a good seal when attaching components such as a top sealing member, a rim, etc. to the tubular container body by heat sealing techniques such as welding. A further plastic layer may be arranged on the outside of the carton layer to protect the carton layer from ambient moisture and to enhance the appearance of the container.

The inside score lines 14, 15 are arranged in said laminate sheet material 8 from said inside surface 6 of the body blank 1 through a full thickness of the inside polymeric layer 11, through a full thickness of an optional metal foil layer 19 and through only a part of the thickness of the carton layer 10.

The inside polymeric layer 11 may have a thickness of from 20 micrometer to 100 micrometer, such as from 30 micrometer to 75 micrometer or from 30 micrometer to 50 micrometer.

The inside score lines 14, 15 are made by partially cutting or punching through the thickness of the body blank 1, as set out herein, thereby creating the tear strip 13 including a band-shaped portion of the inside polymeric layer 11 of the body blank which is defined between the inside score lines 14, 15.

The separation arrangement 12 comprises an opening part 21 for accessing a first and a second pull-tab 22, 23 comprising a first and a second end 22', 23' of the tear strip 13. In the embodiment shown in FIGS. 1*a* to 1*c*, the opening part 21 comprises a portion of the carton layer 10 and is formed by cutting or punching a set of opening part outside score lines 16 in the laminate sheet material 8 from the outside surface of the body blank 1 through only a part of the thickness, t, of the laminate sheet material 8 at the first and second ends 22', 23' of the tear strip 13.

The first and second pull-tabs 22,23 are formed by first and second sets of first pull-tab outside score lines 24, 25 which are arranged in the laminate sheet material 8 from the outside surface 7 of the body blank 1 through only a part of the thickness, t, of the laminate sheet material 8.

As can be seen in FIGS. 1*a* to 1*c*, the tear strip 13 is a two-part tear strip 13 with one part of the tear strip arranged at each side of the opening part 21 and the pull-tabs 22, 23. In an assembled composite container, the two parts of the tear strip 13 will be separated by a seal in the tubular body of the composite container which is formed between two side edges 4,5 of the body blank forming the tubular body of the composite container. In the embodiment illustrated in FIGS. 1*a* to 1*c*, the inside score lines 14, 15 terminate a short distance from the side edges 4, 5 corresponding to the area occupied by a sealing strip when the side edges 4,5 are joined in a body seal in a composite container as disclosed herein. Alternatively, the inside score lines 14, may extend all the way to the side edges 4,5.

Figure 3:
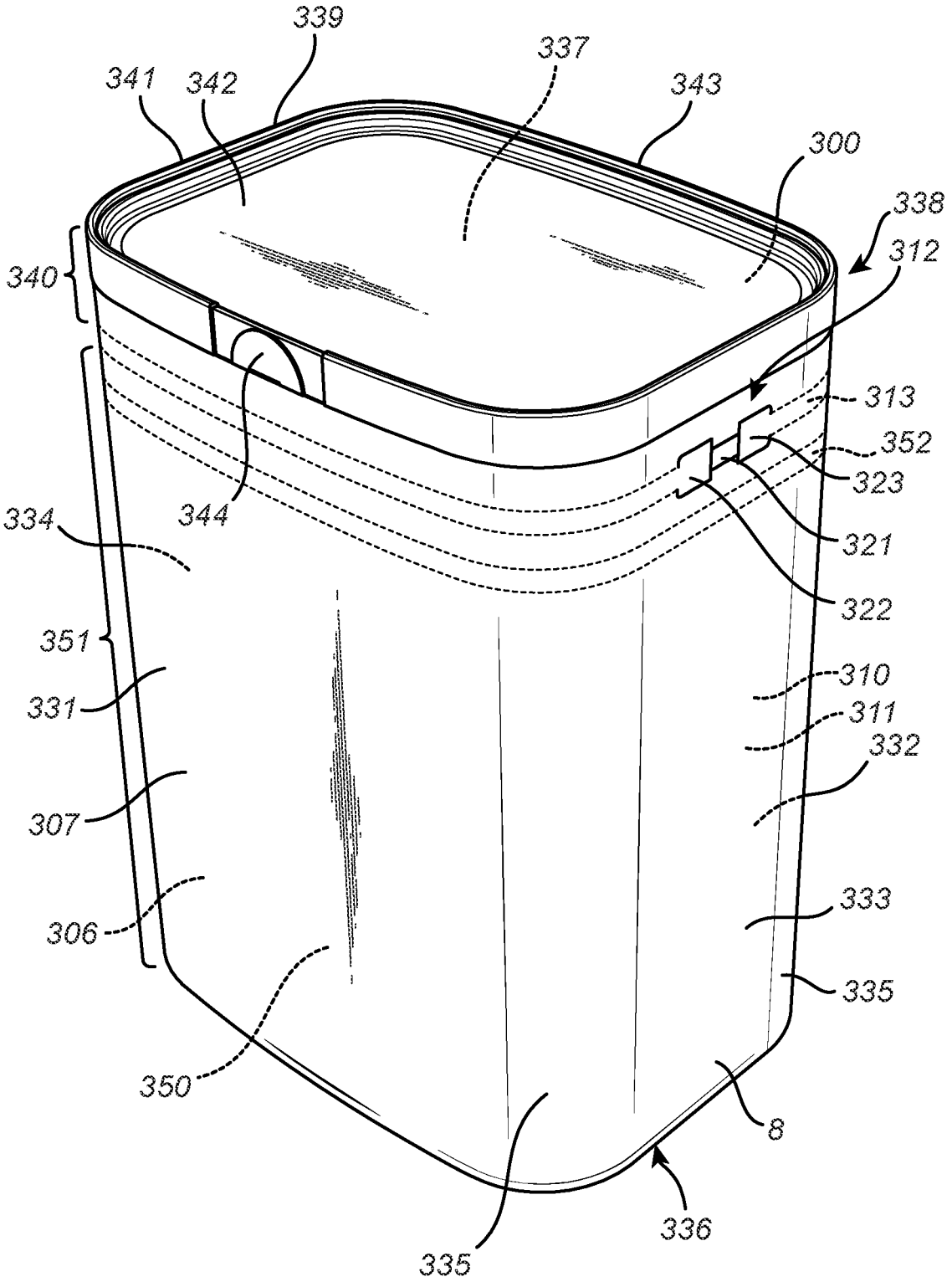
FIG. 3 shows a composite container with a separation arrangement as disclosed herein.

The composite container 300 which is shown in FIG. 3 comprises a tubular body 301. In analogy with the body blank 1 shown in FIGS. 1*a* to 1*c*, the tubular body 301 has an inside surface 306 and an outside surface 307.

The tubular body 301 of the composite container 300 which is shown in FIG. 3 has a modified square cross-sectional shape including a front wall portion 331, a rear wall portion 332 and two side wall portions 333,334 being connected by curved corner portions 335. The cross-sectional shape of the composite container 300 which is shown in FIG. 3 should not be considered to be limiting to the invention. Accordingly, any suitable cross-sectional shape may be used, as known in the art.

Figure 5:
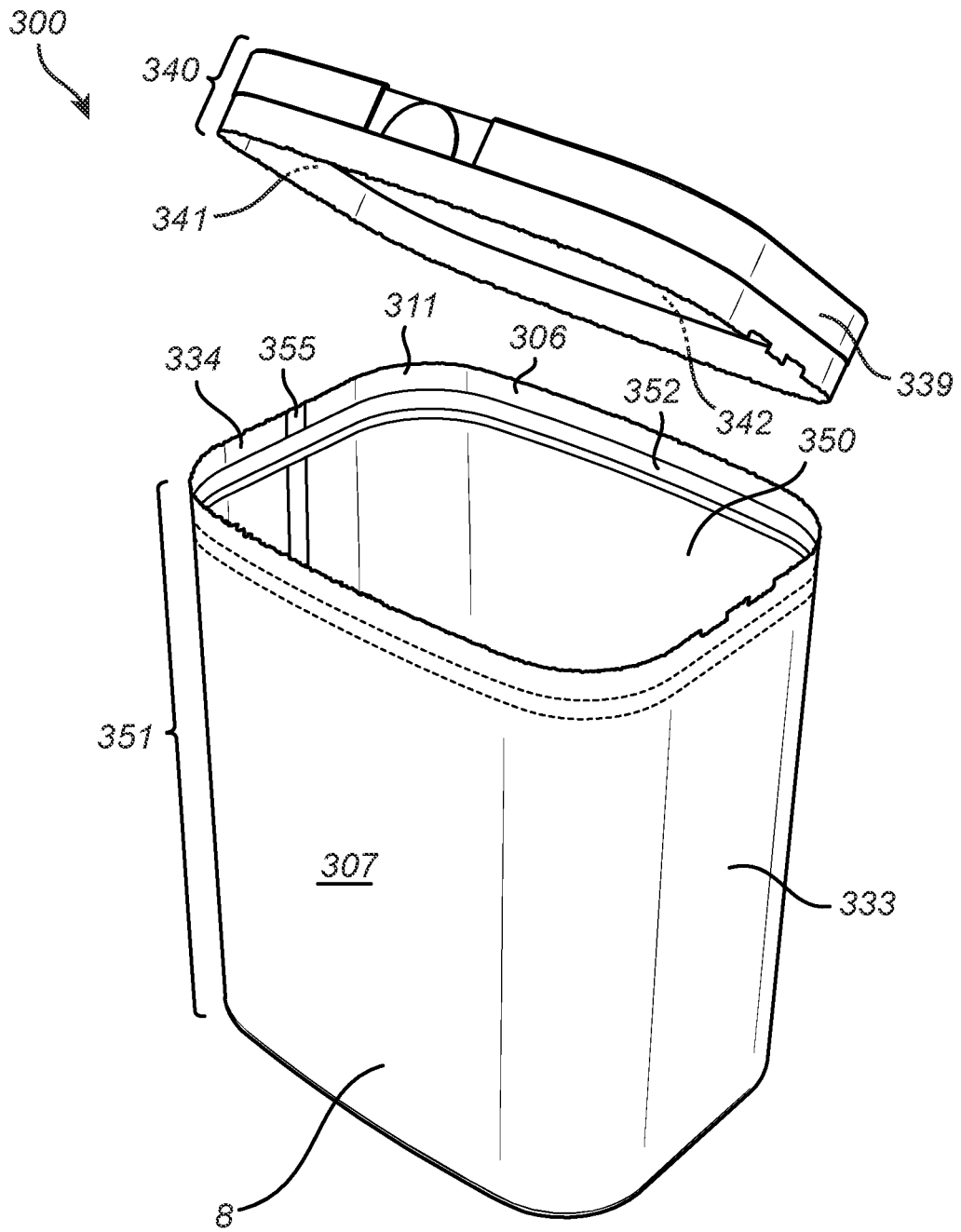
FIG. 5 shows the composite container in FIG. 2 with the top part torn off.

As set out herein, the tubular body 301 may be formed by bringing together the side edges of a body blank, such as the side edges 4, 5 of the body blank 1 shown in FIGS. 1*a* to 1*c*, causing the material to assume a tubular shape and sealing the side edges together. Sealing of the side edges may be made by any suitable method as known in the art, such as by welding or gluing, with high frequency induction welding being preferred, as set out herein. Sealing of the side edges of the body blank may involve using a sealing strip, as known in the art. In the composite container 300 which is shown in FIG. 5 with the top end portion 304 torn off from the main portion 351 of the tubular body 301, a sealing strip 355 is visible on the inside 306 of the tubular body 301 at the side wall 334 which is opposite the side wall 333 in which the separation arrangement 312 is arranged.

The tubular body 301 is closed at a bottom end 336 of the tubular body 301 by means of a bottom sealing member. Alternative bottom sealing arrangements may be used, as set out herein. The closure at the bottom end is opposite a container opening 337 arranged at a top end 338 of the tubular body 301.

The tubular body 301 is made from a laminate sheet material 8, as set out herein and comprises a carton layer 310 and an inside polymeric layer 311, the inside polymeric layer 311 being arranged on the inside surface 306 of the tubular body 301, the inside surface 306 facing towards an inner compartment 350 in the composite container 300.

The composite container 300 comprises a top rim 339 which is a loop-shaped component surrounding the container opening 337. The top rim 339 is firmly attached to a top end portion 340 of the tubular body 301 at the top end 338 of the tubular body 301 by adhesive or welding.

The top rim 339 is preferably a molded thermoplastic component. In the composite container shown in FIG. 3, the top rim 339 is part of a lid component 341, the lid component 341 further comprising a lid 342 for opening and closing the composite container 300. The lid 342 is attached to the top rim 339 by means of a hinge 343, illustrated in FIG. 3 by a live hinge, formed integrally with the top rim 339 and the lid 342, as set out herein. Furthermore, a locking arrangement 344 is arranged at the front wall portion 331 of the tubular body 301 for locking the lid 342 in a closed position over the container opening 337.

The inner compartment 350 is sealed by a fully or partly removable top sealing member 352 which is applied over the contents in the composite container and which is sealed with an edge flange to the inside surface 306 of the tubular body 301, as set out herein. The top sealing member 352 is an optional feature of the disclosed composite container 300 and may be omitted.

The composite container 300 is provided with a separation arrangement 312, for separating the top end portion 340 of the tubular body 301 together with the attached top rim 339 from a main part 351 of the tubular body 301. The separation arrangement 312 comprises a tear strip 313.

Figure 4A:
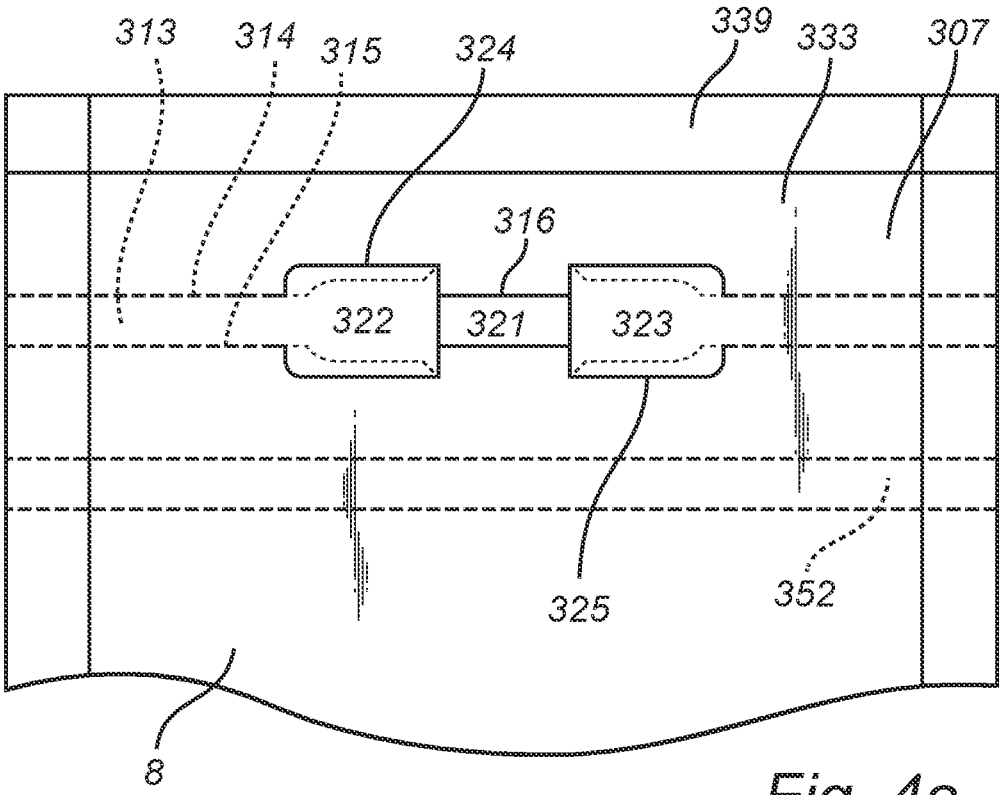
FIG. 4*a* shows a detailed view of the separation arrangement in a side wall of the composite container in FIG. 2 before opening.
Figure 4B:
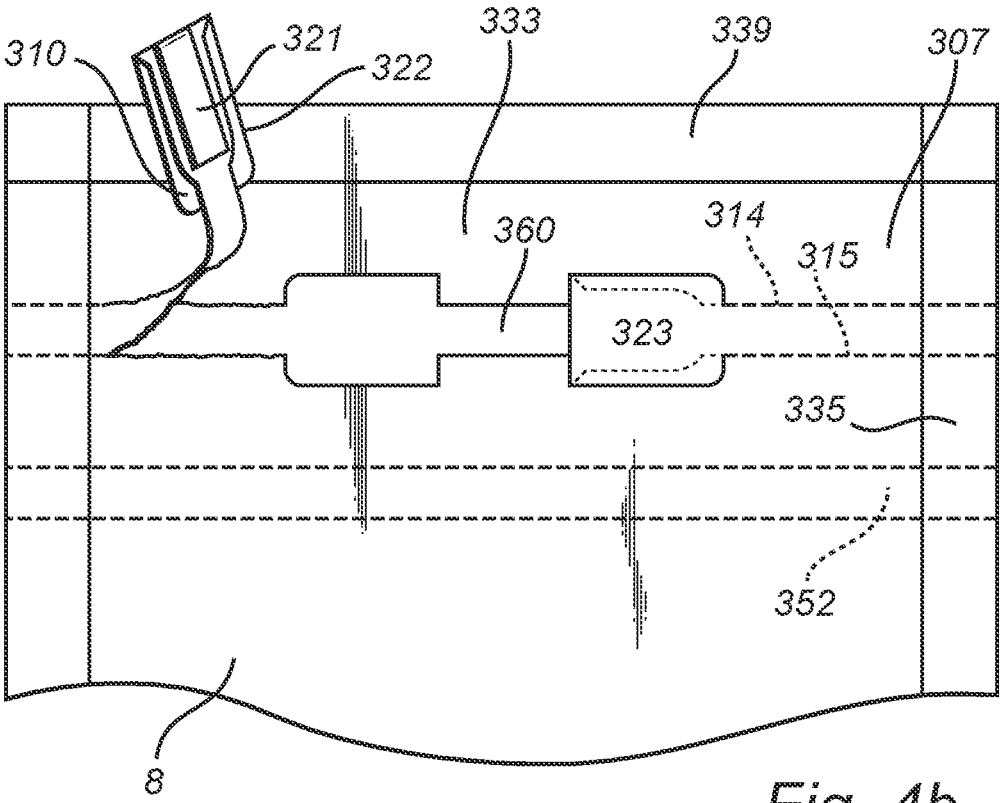
FIG. 4*b* shows the separation arrangement in FIG. 3*a* in the process of being opened.

The separation arrangement 312 is shown in greater detail in FIGS. 4*a* and 4*b* which show an upper part of the composite container 300 as seen from the side wall 333 of the tubular body 301 in which the separation arrangement 312 is located. With reference to FIGS. 4*a* and 4*b*, the tear strip 313 is formed between two inside score lines 314,315 which are arranged in the tubular body 301 through only a part of the thickness, t, of the laminate sheet material 8 forming the tubular body.

The tear strip 313 extends in a circumferential direction of the tubular body 301, adjacent the top rim 339, as shown in FIG. 3.

The separation arrangement 312 further comprises an opening part 321 for accessing a first and a second pull-tab 322, 323. The opening part 321 comprises a portion of the carton layer 310 and is formed by cutting or punching a set of opening part outside score lines 316 in the laminate sheet material 8 from the outside surface 307 of the tubular body 301 through only a part of the thickness, t, of the laminate sheet material 8.

The first and second pull-tabs 322, 323 are formed by first and second sets of pull-tab outside score lines 324, 325 which are arranged in the laminate sheet material 8 from the outside surface 307 of the tubular body 301 through only a part of the thickness, t, of the laminate sheet material 8.

As in the body blank 1 in FIGS. 1*a* to 1*c*, the tear strip 313 is a two-part tear strip 313 with one part of the tear strip arranged at each side of the opening part 321 and the pull-tabs 322, 323. The two parts of the tear strip 313 are separated by a seal in the tubular body 301 of the composite container 300 which is formed in the side wall 334 of the tubular body 301 which is opposite the side wall 333 in which the separation arrangement 312 is located. The seal is covered by a sealing strip 355 as illustrated in FIG. 5.

When the composite container 300 has been emptied of its contents, it may be prepared for recycling by a user forming an access opening 360 in the tubular body 301 by pushing the opening part 321 in a direction towards the inner compartment 350 of the tubular body 301 and inserting a finger into the access opening 360 in the tubular body 301 and gripping a pull-tab 322 or 323. In FIG. 4*b*, the separation arrangement 312 is shown with the opening part 321 pushed away and folded back on the pull-tab 322 which is shown on the left in FIGS. 4*a* and 4*b*. Accordingly, the opening part stays connected to the left-hand pull-tab 322 and forms part of the pull-tab 322. As disclosed herein, the opening part may alternatively be completely pushed through the wall of the tubular body 301 and fall down into the inner compartment 350 or may stay attached to the side wall material at the upper or lower part of the access opening 360, or may stay attached to the pull-tab which is shown on the right in FIGS. 4*a* and 4*b*.

After having exposed and gripped the pull-tab 322 or 323, the user may tear open the sheet material 8 in the tubular body 301 by pulling along tear strip 313 to the sealing strip 355 opposite the separation arrangement 312. In a two-part tear strip arrangement as shown in FIG. 3 and FIGS. 4*a* and 4*b*, the tearing is repeated from the other side of the opening 360 which has been created in the tubular body 301.

After completing tearing of both parts of the tear strip 313, the user may separate the top end portion 340 of the composite container 300 from the main part 351 of the tubular body 301, constituted by a narrow strip of the tubular body 301 and the attached lid component 341, as shown in FIG. 5.

The invention claimed is:

1. A composite container comprising:

a tubular body, said tubular body having an inside surface and an outside surface and being closed at a bottom end of said tubular body opposite a container opening at a top end of said tubular body, said tubular body being made from a laminate sheet material comprising a carton layer and an inside polymeric layer, said inside polymeric layer being arranged at an inside surface of said carton layer, said composite container comprising a top rim surrounding said container opening, said top rim being attached to a top end portion of said tubular body at said top end of said tubular body, and a lid for opening and closing said composite container, said composite container comprises a separation arrangement, for separating said top end portion of said tubular body together with said attached top rim from a main part of said tubular body, said separation arrangement comprising a tear strip comprising a portion of said inside polymeric layer, said tear strip being formed between a pair of inside score lines which are arranged in said laminate sheet material from said inside surface of said tubular body through only a part of a thickness of said laminate sheet material, said inside score lines and said tear strip extending in a circumferential direction of said tubular body, adjacent said top rim and wherein said separation arrangement comprises a first pull-tab which is arranged at a first end of said tear strip, said first pull-tab comprising a portion of said carton layer and being formed by a set of first pull-tab outside score lines arranged in said laminate sheet material from said outside surface of said tubular body through only a part of said thickness of said laminate sheet material.

2. A composite container according to claim 1, wherein said tear strip has an extension in said circumferential direction of said tubular body corresponding to at least 45% of a circumference of said tubular body.

3. A composite container according to claim 1, wherein said separation arrangement comprises a first opening part for accessing a first end of said tear strip, said first opening part comprising a portion of said carton layer and being formed by a set of opening part outside score lines arranged in said laminate sheet material from said outside surface of said tubular body through only a part of said thickness of said laminate sheet material adjacent said first end of said tear strip.

4. A composite container according to claim 1, wherein said separation arrangement comprises a second pull-tab which is arranged at a second end of said tear strip, said second pull-tab comprising a portion of said carton layer and being formed by a set of second pull-tab outside score lines arranged in said laminate sheet material from said outside surface of said tubular body through only a part of said thickness of said laminate sheet material.

5. A composite container according to claim 1, wherein said inside score lines are arranged in said laminate sheet material from said inside surface of said tubular body through a full thickness of said inside polymeric layer and through only a part of a thickness of said carton layer.

6. A composite container according to claim 1, wherein said inside polymeric layer has a thickness from 20 micrometers to 100 micrometers.

7. A composite container according to claim 1, wherein said inside score lines of said pair of inside score lines are arranged at a distance from each other from 3 millimeters to 10 millimeters.

8. A composite container according to claim 1, wherein a distance between a lower edge of said top rim and said tear strip is less than 15 millimeters.

9. A composite container according to claim 8, wherein said distance between said lower edge of said top rim and said tear strip varies along a length of said tear strip.

10. A composite container according to claim 1, wherein said composite container comprises a top sealing member which is attached to said inside surface of said tubular body at a distance from said top end of said tubular body, said separation arrangement being arranged between said top sealing member and said top rim.

11. A composite container according to claim 1, wherein said lid is a part of a lid component, said lid component comprising said top rim and a lid part, or a frame structure and a lid part.

12. A rectangular body blank for forming a tubular body in a composite container in accordance with claim 1, said body blank having a top edge and a bottom edge and two side edges, an inside surface and an outside surface, said body blank being made from a laminate sheet material comprising a carton layer and an inside polymeric layer, said inside polymeric layer being arranged at said inside surface of said body blank, said body blank comprises a separation arrangement comprising a tear strip, said tear strip comprising a portion of said inside polymeric layer, said tear strip being formed between two inside score lines which are arranged in said laminate sheet material from said inside surface of said body blank through only a part of a thickness of said laminate sheet material and extending along said top edge of said body blank and wherein said separation arrangement comprises a first pull-tab which is arranged at a first end of said tear strip, said first pull-tab comprising a portion of said carton layer and being formed by a set of first pull-tab outside score lines arranged in said laminate sheet material from said outside surface of said body blank through only a part of said thickness of said laminate sheet material.

13. A method of separating a top end portion of a composite container from a main body portion of said composite container, said composite container comprising a tubular body, said tubular body having an inside surface and an outside surface and being closed at a bottom end of said tubular body opposite a container opening at a top end of said tubular body, said tubular body being made from a laminate sheet material comprising a carton layer and an inside polymeric layer, said inside polymeric layer being arranged at an inside surface of said carton layer, said composite container comprising a top rim surrounding said container opening, said top rim being attached to a top end portion of said tubular body at said top end of said tubular body, and a lid for opening and closing said composite container, said composite container further comprises a separation arrangement, for separating said top end portion of said composite container from said main body portion of said composite container, said separation arrangement comprising a tear strip comprising a portion of said inside polymeric layer, said tear strip being formed between a pair of inside score lines which are arranged in said laminate sheet material from said inside surface of said tubular body through only a part of a thickness of said laminate sheet material, said inside score lines and said tear strip extending in a circumferential direction of said tubular body, adjacent said top rim, and an opening part for accessing an end of said tear strip, said opening part comprising a portion of said carton layer and being formed by outside score lines arranged in said laminate sheet material from said outside surface of said tubular body through only a part of said thickness of said laminate sheet material adjacent said end of said tear strip, and a pull-tab which is arranged at said end of said tear strip, said pull-tab comprising a portion of said carton layer and being formed by outside score lines arranged in said laminate sheet material from said outside surface of said tubular body through only a part of said thickness of said laminate sheet material, wherein said method comprises the steps of:

forming an access opening in said tubular body by pushing said opening part in a direction towards an interior of said tubular body;

inserting a finger into said access opening in said tubular body and gripping said pull-tab;

tearing said tubular body along said tear strip by pulling at said pull-tab; and removing said top end portion of said composite container from a main part of said composite container.

14. A composite container according to claim 1, wherein said separation arrangement comprises an opening part for accessing a first end of said tear strip, said opening part comprising a portion of said carton layer and being formed by a set of opening part outside score lines arranged in said laminate sheet material from said outside surface of said tubular body through only a part of said thickness of said laminate sheet material adjacent said first end of said tear strip, wherein the opening part and the set of opening part outside score lines are configured for forming an access opening in the tubular body for facilitating gripping of the first pull-tab via the access opening.

15. A composite container according to claim 14, wherein the opening part is configured to be pushed in a direction towards an interior of the tubular body to form the access opening.

16. A composite container according to claim 14, wherein the opening part is configured to be folded back on the first pull-tab when the access opening is formed.

* * * * *